US006499826B1

(12) United States Patent
Kline et al.

(10) Patent No.: US 6,499,826 B1
(45) Date of Patent: Dec. 31, 2002

(54) HORIZONTALLY LOADABLE CARRIAGE FOR AN INK-JET PRINTER

(75) Inventors: Daniel S Kline, Encinitas, CA (US); Junji Yamamoto, San Diego, CA (US); Chee Meng Chen, Singapore (SG)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/477,644

(22) Filed: Jan. 5, 2000

(51) Int. Cl.[7] ..... B41J 23/00
(52) U.S. Cl. ..... 347/37
(58) Field of Search ..... 347/49, 50, 37, 347/87, 86

(56) References Cited

U.S. PATENT DOCUMENTS

| | | | | |
|---|---|---|---|---|
| 4,706,097 A | | 11/1987 | Harmon | |
| 4,709,245 A | * | 11/1987 | Piatt | 347/49 |
| 4,755,836 A | | 7/1988 | Ta et al. | |
| 4,872,026 A | | 10/1989 | Rasmussen et al. | |
| 4,907,018 A | | 3/1990 | Pinkerpell | |
| 4,965,596 A | * | 10/1990 | Nagoshi et al. | 347/86 X |
| 5,138,342 A | * | 8/1992 | Kurata et al. | 347/50 |
| 5,138,344 A | * | 8/1992 | Ujita | 347/86 |
| 5,392,063 A | | 2/1995 | Rhoads | 347/49 |
| 5,500,664 A | | 3/1996 | Suzuki et al. | |
| 5,541,631 A | | 7/1996 | Hashimoto | |
| 5,847,731 A | * | 12/1998 | Kashimura et al. | 347/49 |
| 5,940,658 A | * | 8/1999 | Yokoi et al. | 399/119 |
| 5,949,459 A | | 9/1999 | Gasvoda et al. | |
| 6,022,103 A | * | 2/2000 | Yamaguchi | 347/86 |
| 6,102,533 A | * | 8/2000 | Nozawa et al. | 347/86 |

FOREIGN PATENT DOCUMENTS

| | | | | |
|---|---|---|---|---|
| EP | 756936 A2 | | 2/1997 | |
| JP | 62255151 | | 11/1987 | |
| JP | 11-286154 | * | 10/1999 | B41J/2/175 |

* cited by examiner

*Primary Examiner*—Thinh Nguyen

(57) ABSTRACT

A horizontally loadable carriage for an ink-jet print cartridge. The carriage scans in an ink-jet printer and includes a carriage body, a chute for receiving an ink-jet print cartridge, and a generally horizontal guide rail within the chute. The guide rail is arcuate and inclined slightly upward to facilitate loading print cartridges into the carriage. The carriage further includes a cantilever bias spring having a horizontal axis.

6 Claims, 6 Drawing Sheets

HORIZONTALLY LOADABLE CARRIAGE FOR AN INK-JET PRINTER

RELATED APPLICATIONS

This application is related to the following copending utility patent applications, each filed concurrently on Jan. 5, 2000:

- Ser. No.: 09/477,645 by Ram Santhanam et al., entitled "Vent For An Ink-Jet Print Cartridge";
- Ser. No.: 09/477,646 by Ram Santhanam et al., entitled "Ink-Jet Print Cartridge Having A Low Profile";
- Ser. No.: 09/477,649 by Junji Yamamoto et al., entitled "Method And Apparatus For Horizontally Loading And Unloading An Ink-Jet Print Cartridge From A Carriage";
- Ser. No.: 09/478,148 by Richard A. Becker et al., entitled "Techniques For Providing Ink-Jet Cartridges With A Universal Body Structure";
- Ser. No.: 09/477,843 by Ram Santhanam et al., entitled "Techniques For Adapting A Small Form Factor Ink-Jet Cartridge For Use In A Carriage Sized For A Large Form Factor Cartridge";
- Ser. No.: 09/478,190 by James M. Osmus, entitled "Printer With A Two Roller, Two Motor Paper Delivery System";
- Ser. No.: 09/477,860 by Keng Leong Ng, entitled "Low Height Inkjet Service Station";
- Ser. No.: 09/477648 by Matt Shepherd et al., entitled "New Method of Propelling An Inkjet Printer Carriage";
- Ser. No.: 29/116,564 by Ram Santhanam et al., entitled "Ink Jet Print Cartridge"; and
- Ser. No.: 09/477,940 by Ram Santhanam et al., entitled "Multiple Bit Matrix Configuration For Key-Latched Printheads", all of which are incorporated by reference.

FIELD OF INVENTION

The present invention generally relates to ink-jet printers and, more particularly, to the components and subsystems therein.

The general design and construction of carriages that retain and align ink-jet print cartridges in printers and scan these print cartridges through print zones is well known. Examples of the patents that have issued in this field of technology include:

- U.S. Pat. No. 4,755,836 entitled "Printhead Cartridge and Carriage Assembly" by Ta et al. issued Jul. 5, 1988
- U.S. Pat. No. 4,872,026 entitled "Ink-jet Printer with Printhead Carriage Alignment Mechanism" by Rasmussen et al. issued Oct. 3, 1989
- U.S. Pat. No. 4,907,018 entitled "Printhead-Carriage Alignment and Electrical Interconnect Lock-in Mechanism" by Pinkerpell issued Mar. 6, 1990
- U.S. Pat. No. 5,392,063 entitled "Spring Cartridge Clamp for Inkjet Printer Carriage" by Rhoads issued Feb. 21, 1995.

Prior carriages have been designed to be loaded and unloaded either vertically or with a steep, inclined (i.e., generally vertical), arcuate motion. Such carriages have proven to be satisfactory as long as vertical access to the printer is provided. This has meant, however, that nothing could be permanently stacked on top of the printer.

Further, previous top loading ink-jet printer designs have fostered an increasing growth in printer height so that with each new printer design, the profile of the product grew and grew.

Additionally, it is believed that end users want a printer for home use that can be stacked in an entertainment center or used in living rooms. This is a printer that has flat top and bottom walls, that is front loading with all controls and status indicators on the front wall, and that is about the same size as a conventional stereo amplifier or a video cassette recorder (VCR). In other words, this is a horizontally loadable ink-jet printer with an overall height of less than four inches (4").

Such requirements result in numerous design challenges. First, nearly all existing datum structures on present day ink-jet print cartridges are designed for vertical or near vertical installation. Front or horizontal loading has heretofore not been contemplated so if an existing datum structure is to be used, the print cartridge must be positioned in an entirely new manner. Second, on a front loading printer the field of view available to a user during cartridge installation is quite restricted. The user sees less of the carriage and less of the loading process. Third, physical access to the carriage is more limited. Fourth, if multiple print cartridges are used, they must sit so close together that much of their gripping surfaces is unavailable for unloading the print cartridge from the printer.

Thus, it is apparent from the foregoing that although there are many different carriage designs, designing a front loading, stackable, low height ink-jet printer presents many challenges.

SUMMARY OF THE INVENTION

Briefly and in general terms, an apparatus according to the invention includes a a carriage body translatable within an ink-jet printer, a chute mounted on the carriage body for receiving an ink-jet print cartridge, and a generally horizontal rail on one of the sidewalls of the chute for guiding an ink-jet print cartridge generally horizontally into and out of the carriage.

Other aspects and advantages of the invention will become apparent from the following detailed description, taken in conjunction with the accompanying drawings, illustrating by way of example the principles of the invention.

DESCRIPTION OF THE PREFERRED EMBODIMENTS

Figure 1:
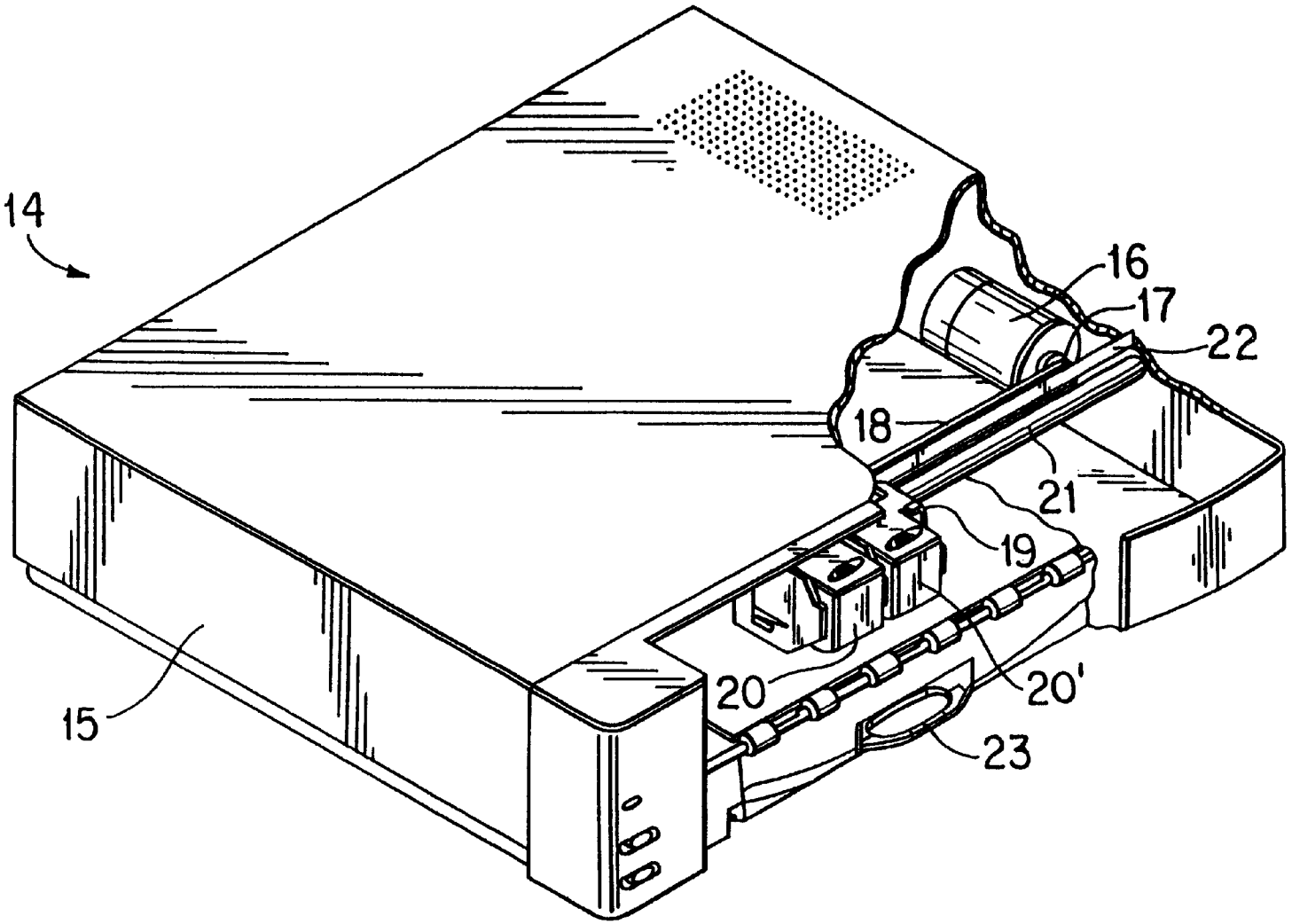
FIG. 1 is a perspective view, in section and partially cut away, of an ink-jet printer embodying the principles of the invention.

As shown in the drawings for the purposes of illustration, the invention is embodied in a front loading, stackable, low height, ink-jet printer.

The apparatus offers a simple, inexpensive solution, easy self-evident operation, and leverages the datum structure from a print cartridge currently in production.

Referring to FIG. 1, reference numeral 14 generally indicates an ink-jet printer partially cut away and with its front loading door removed. The printer includes a case part 15 and a DC drive motor 16 mounted on a chassis. Mounted on the shaft of the motor 16 is a pulley 17 that drives a belt 18 back and forth as the drive motor reverses in direction. The drive belt 18 is attached to a carriage 19 that scans laterally back and forth from left to right and right to left. The carriage 19 contains two thermal ink-jet print cartridges 20, 20' located side by side. Print cartridge 20 contains black ink, and print cartridge 20' has three ink chambers containing magenta, yellow and cyan inks. The horizontal scanning motion of the carriage is guided by a slide rod 21. Located in the rear of the carriage 19 is an encoder, not shown, that reads an encoder strip 22 that enables the electronic circuits in the printer to locate the carriage 19 along its scanning path. After the printer 14 prints a sheet of media, the media is ejected into an output tray on which a handle 23 is mounted.

Figure 2:
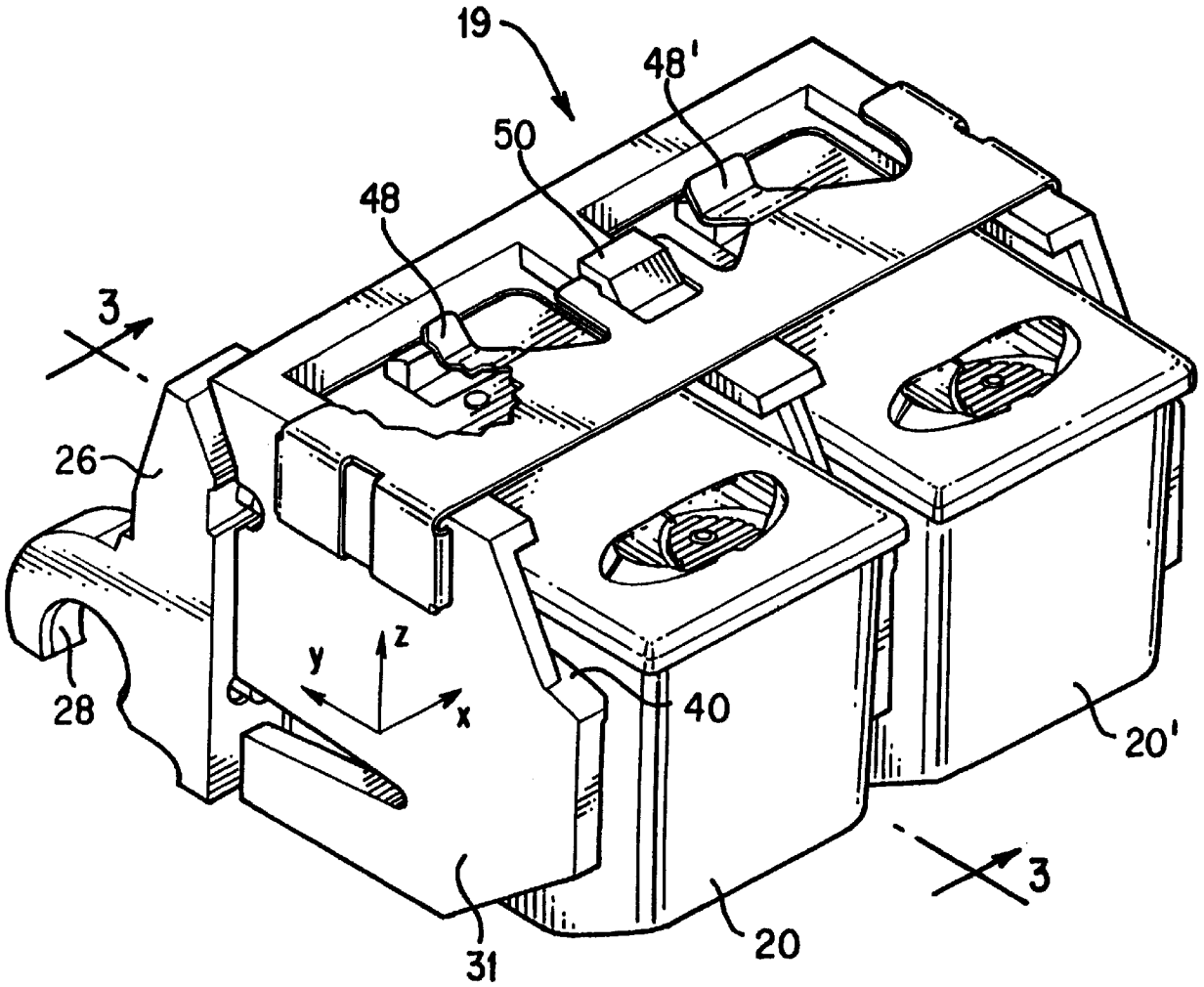
FIG. 2 is a perspective view, in section and partially cut away of the carriage of the ink-jet printer of FIG. 1.

In FIG. 2, the "X" axis is parallel with the longitudinal axis of the slide rod 21, FIG. 1. The "Y" axis is pointed to the rear and into the printer 14, FIG. 1, and is in the reverse direction to the path of the paper through the print zone. The "Z" axis is pointing vertically upward.

Figure 7:
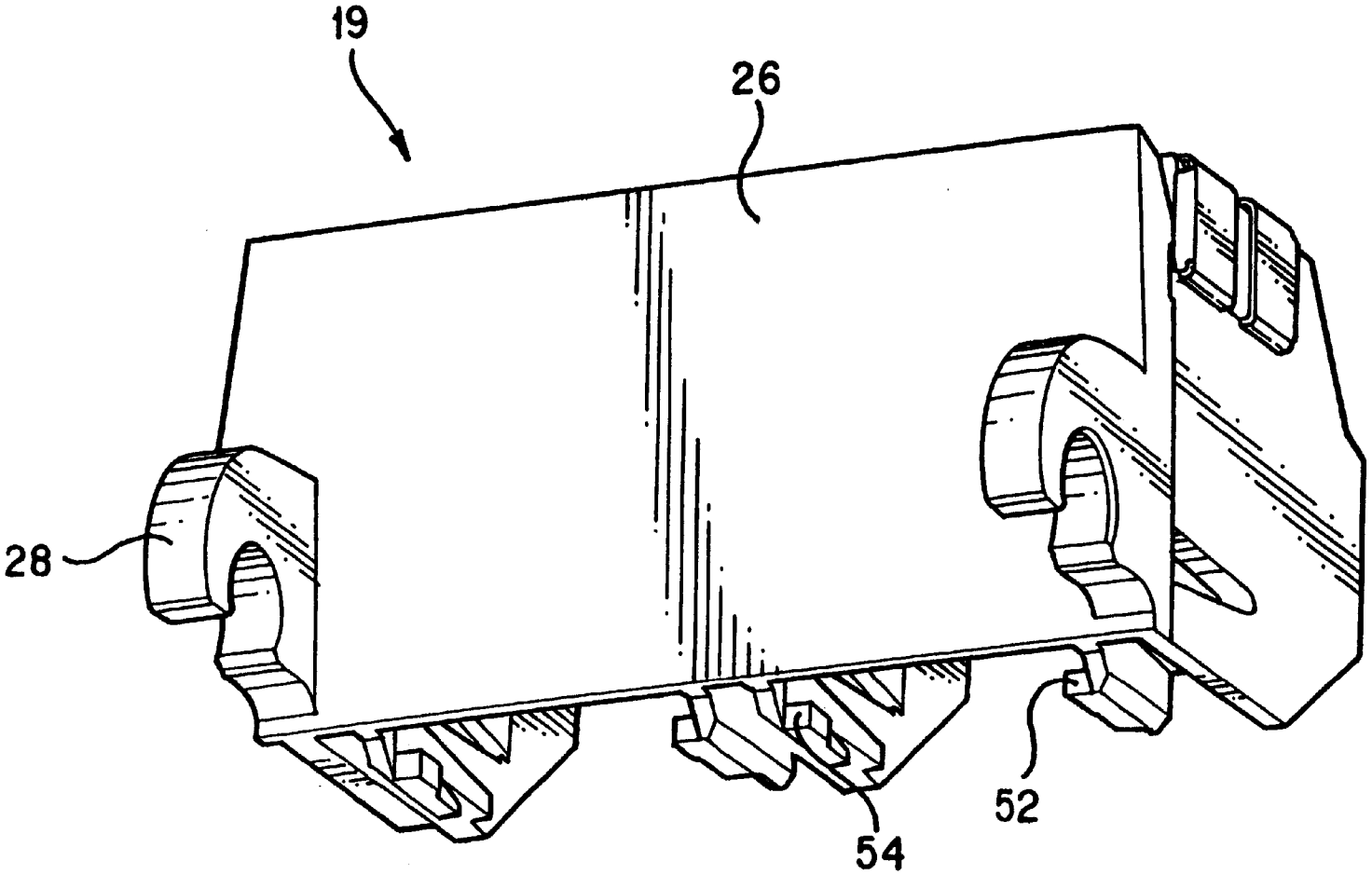
FIG. 7 is a rear perspective view of the carriage of FIG. 2, with the print cartridges removed.

Referring now particularly to FIGS. 2 and 7, the carriage 19 includes a carriage base 26 that supports the structure. The carriage base has two "C" shaped arch supports 28 located at its ends. These arch supports provide bearing support and engage the slide rod 21, FIG. 1.

Figure 5:
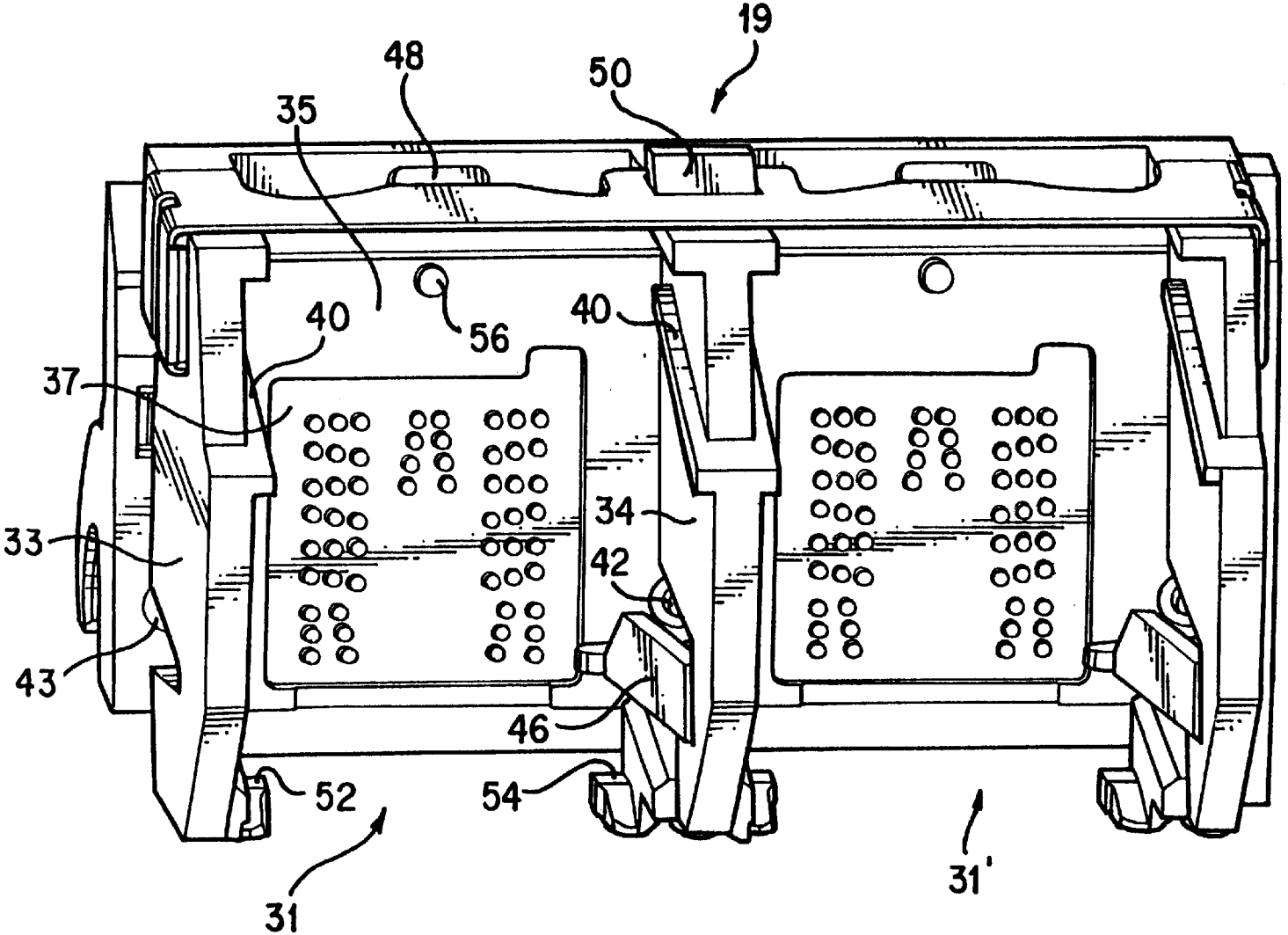
FIGS. 5 and 6 are front perspective views of the carriage of FIG. 2, with the print cartridges removed.
Figure 6:
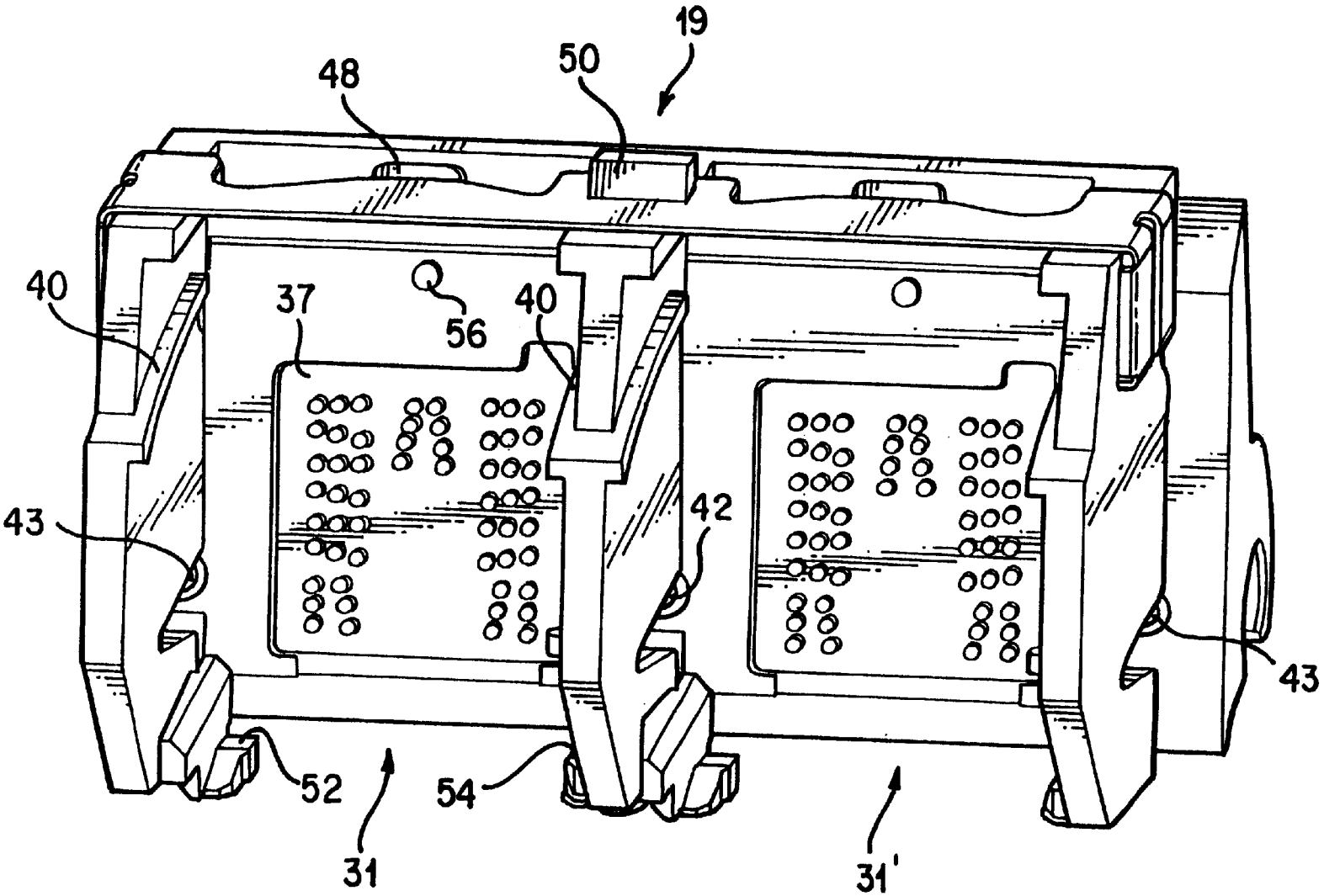

Referring to FIGS. 2, 5, and 6, the carriage 19 also includes two chutes 31 that each receive, hold, and align a respective one of the ink-jet print cartridge 20 and 20 "as illustrated in FIG. 2. Both chutes 31 are constructed and operate in the same manner; so for brevity only the left chute will be described. The chute 31 has a left side wall 33, a right side wall 34 (best seen in FIGS. 3, 5, and 6), and a rear or end wall 35. Located on the rear wall 35 of the chute is a dimpled contact pad 37. The contact pad has an elastomeric backing and contains electrical contacts that are urged against corresponding contacts on the print cartridge 20. In this manner the printer 14 makes electrical contact with the print cartridge and supplies electrical energy to the firing resistors during printing.

Dimpled contact pads for thermal ink-jet print cartridges and carriages are disclosed in U.S. Pat. No. 4,706,097 entitled "Near-Linear Spring Connect Structure for Flexible Interconnect Circuits" by Harmon issued Nov. 10, 1987.

Figure 3:
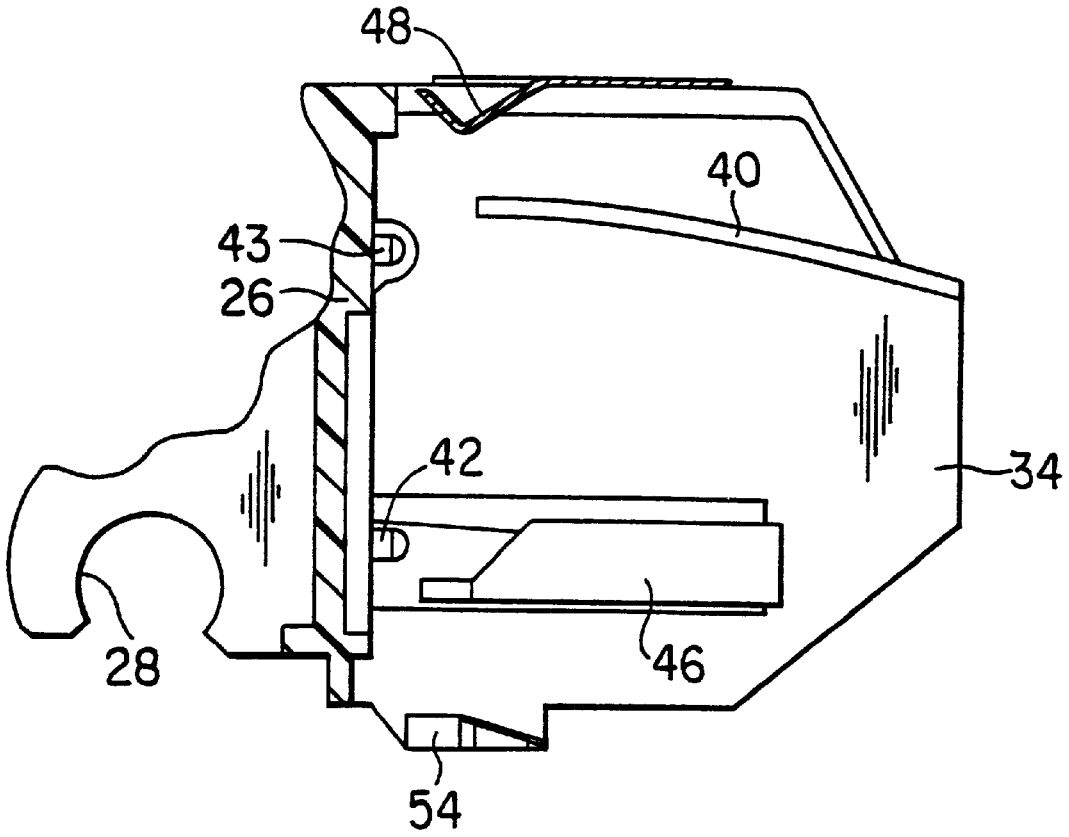
FIG. 3 is a side elevational view, in section, taken along line 3—3 of the carriage of FIG. 2, with the print cartridge removed.

The dimpled contact pads 37, FIGS. 3, 5, and 6, are held in place against the rear wall 35 of each chute 31 by six pins 42, 43 located on the carriage base 26. Pin 42 locates the dimpled contact pad left and right and vertically in the carriage 19. The other five pins prevent the contact pad from rotating about the center pin 42 and inducing any stress in the contact pad.

Referring to FIGS. 3, 5, and 6, located on each side wall 33, 34, of the chute 31 is a respective one of a pair of opposite, inwardly extending guide rails 40. The guide rails 40 are the guiding feature controlling vertical and angular orientations of the print cartridges during installing and removing movements of the print cartridges, respectively, into and from the printer 14. Thus, these guide rails cooperatively define a horizontal action line, indicated with lines 40' in FIG. 2. Referring to FIG. 3, in particular, each guide rail 40 is generally horizontal, curved, arcuate, and is inclined slightly upward toward the rear wall 35 in the positive "Y" direction (recalling the reference directions as illustrated in FIG. 2). The guide rails 40 engage the bottom of the lips (indicated with reference numeral **40*a* on FIG. 2), which are located on the side walls 20*a* of certain print cartridges and which extend outwardly and laterally from adjacent to the top of the generally rectangular prismatic body 21** of these print cartridges.

Further, the guide rails 40 in the chutes 31, FIGS. 5 and 6 serve many functions. First, the rails act as a target for the user when initially installing a print cartridge. They aid in locating the print cartridge 20 in the carriage 19, FIG. 1 which is only partially visible to the user. Second, once the print cartridge is resting on the guide rails 40 and the print cartridge 20 is pushed rearwardly by the user (i.e., toward the rear wall 35), the guide rails 40 guide the print cartridge 20 up and over the primary and secondary carriage datums, which are described in detail below. Third, when a print cartridge is being unlatched from the carriage by the user, the guide rails limit the resulting forward and downward rotation of the print cartridge so that it does not come tumbling out of the printer.

Referring to FIGS. 3 and 5, located in the right side wall 34 of each chute 31 is a cantilever spring 46. The spring 46 has a major axis that is horizontal. The cantilever spring biases or urges the print cartridge horizontally in the negative "X" direction as illustrated in FIG. 2, against the primary datums, as described in detail below.

Figure 4:
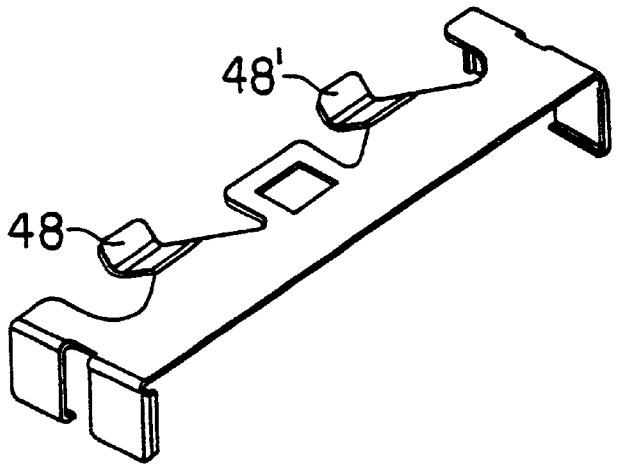
FIG. 4 is a perspective view of the latch spring of the carriage of FIG. 2.

In FIGS. 2, 3, 4, 5, and 6, reference numeral 48 indicates a latch spring having a horizontal tab pointing rearward in an ink-jet printer 14, FIG. 1, along the "Y" axis as illustrated in FIG. 2. The spring is directed in this manner to achieve the low printer height objective. The latch spring engages a latch molded into the lid of the print cartridge as illustrated in FIG. 2. There is a latch spring for each chute 31, and they are fabricated from a single sheet metal part as illustrated in FIG. 4. The part is attached to features molded in the outside walls of the chutes 31. The part is also attached to an arresting finger 50 (FIG. 5) located on the center side wall of the carriage 19(i.e., intermediate of the two chutes 31). The arresting finger has the shape of an "L" and prevents the mechanical strain from installing a print cartridge in one chute from affecting the print cartridge in the chute along side.

Referring to FIGS. 5, 6, and 7, located on the inside of the left side wall 33 at the bottom of the chute 31 are the primary datums 52. The corresponding datums on the print cartridge are urged against the primary datums 52 in the chute by the cantilever spring 46 in the right side wall 34 of the chute 31. Located on the inside of the right side wall 34 at the bottom of the chute 31 and directly opposite the primary datums 52 are the secondary datums 54. There is a single tertiary datum 56 located in the rear wall 35 of the chute 31 above the dimpled contact pad 37. The tertiary datum locates the rotation of a print cartridge about the "X" axis to a known point.

Although specific embodiments of the invention have been described and illustrated, the invention is not to be limited to the specific forms or arrangement of parts so described and illustrated. The invention is limited only by the claims.

We claim:

1. A carriage structure for a front-loading ink jet printer, which carriage structure is loadable with an ink jet print cartridge by horizontal inserting motion of the ink jet print cartridge along a horizontal action line extending into the printer and carriage structure, said carriage structure comprising:

said carriage structure defining a chute opening horizontally for insertion of an ink jet print cartridge along said horizontal action line;

said chute including a rear wall, and a pair of horizontally spaced apart and vertically extending side walls extending forwardly from said rear wall and forwardly relative to said printer to receive between them said ink jet cartridge in response to said horizontal inserting motion;

each of said pair of side walls defining a respective one of a pair of inwardly extending rails extending generally horizontally along said side walls and into said chute toward said rear wall for establishing therebetween said horizontal action line, and said pair of rails cooperatively defing an upwardly disposed and open rail surface adjacent to an upper extent of said pair of side walls for supporting and guiding said ink jet print cartridge horizontally into said carriage structure during said horizontal inserting motion; and wherein each of said pair of rails extends generally horizontally, and is inclined upward as it extends into said chute toward said rear wall.

2. A carriage structure for a front-loading ink jet printer, which carriage structure is loadable with an ink jet print cartridge by horizontal inserting motion of the ink jet print cartridge along a horizontal action line extending into the printer and carriage structure, said carriage structure comprising:

said carriage structure defining a chute opening horizontally for insertion of an ink jet print cartridge along said horizontal action line;

said chute including a rear wall, and a pair of horizontally spaced apart and vertically extending structural portions each extending forwardly from said rear wall and forwardly relative to said printer to receive between them said ink jet cartridge in response to said horizontal inserting motion;

each of said pair of structural portions defining a respective one of at least a pair of opposed and inwardly extending protrusions extending toward but short of one another between said pair of structural portions, said at least a pair of opposed protrusions providing an upwardly disposed and upwardly open protrusion surface so that said protrusion surfaces of said pair of protrusions establish therebetween said horizontal action line, and said pair of protrusions at said protrusion surfaces suspending said ink jet print cartridge to hang therebetween and supporting and guiding said ink jet print cartridge horizontally into said carriage structure during said horizontal inserting motion; and wherein each of said at least a pair of protrusions provides an upwardly disposed arcuate protrusion surface upon which said ink-jet print cartridge may rotate rearwardly and upwardly during said horizontal inserting motion.

3. The carriage structure of claim 2 wherein, during an opposite withdrawal motion of said ink-jet print cartridge from said chute along said horizontal action line, said upwardly disposed arcuate protrusion surfaces of said pair of protrusions also provides protrusion surfaces upon which said inkjet print cartridge may rotate downwardly and forwardly.

4. A print carriage for supporting a print cartridge comprising:

a chute including a rear wall, and a pair of horizontally spaced apart and vertically extending side walls extending forwardly from said rearwall to receive between them said print cartridge; and a pair of generally horizontally extending guide rails located on said side walls and extend toward said rear wall. each of said guide rails further including a portion that is inclined upwardly as it extends into said chute.

5. A print carriage for supporting a print cartridge comprising:

a chute including a rearwall, and a pair of horizontally spaced apart and vertically extending side wails extending forwardly from said rear wall to receive between them said print cartridge:

carriage datums disposed at a bottom of said chute proximately to said rear wall; and a pair of generally horizontally extending guide structures located on said side walls for guiding the print cartridge up and over said carriage datums.

6. A print carriage for supporting a print cartridge comprising:

a chute including a rear wall, and a pair of horizontally spaced apart and vertically extending side walls extending forwardly from said rear wall to receive between them said print cartridge; and means located on said side walls for guiding the print cartridge as it is pushed forwardly in said chute.

* * * * *

UNITED STATES PATENT AND TRADEMARK OFFICE

CERTIFICATE OF CORRECTION

PATENT NO. : 6,499,826 B1
DATED : December 31, 2002
INVENTOR(S) : Kline et al.

It is certified that error appears in the above-identified patent and that said Letters Patent is hereby corrected as shown below:

Column 6,
Line 30, "wails" should read -- walls --.

Signed and Sealed this

Eighteenth Day of March, 2003

JAMES E. ROGAN
*Director of the United States Patent and Trademark Office*